US009058804B2

(12) United States Patent
Choi et al.

(10) Patent No.: US 9,058,804 B2
(45) Date of Patent: Jun. 16, 2015

(54) SPEECH SIGNAL TRANSMISSION AND RECEPTION APPARATUSES AND SPEECH SIGNAL TRANSMISSION AND RECEPTION METHODS

(71) Applicant: SAMSUNG ELECTRONICS CO., LTD., Suwon-si, Gyeonggi-do (KR)

(72) Inventors: Byung Kwon Choi, Suwon-si (KR); Young Do Kwon, Yongin-si (KR); Dong Soo Kim, Hwaseong-si (KR); Kyung Shik Roh, Seongnam-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 193 days.

(21) Appl. No.: 13/685,221

(22) Filed: Nov. 26, 2012

(65) Prior Publication Data

US 2013/0138431 A1 May 30, 2013

(30) Foreign Application Priority Data

Nov. 28, 2011 (KR) ..... 10-2011-0124933
Feb. 21, 2012 (KR) ..... 10-2012-0017252

(51) Int. Cl.
*G10L 21/00* (2013.01)
*G10L 19/008* (2013.01)
*G10L 25/21* (2013.01)

(52) U.S. Cl.
CPC ..... *G10L 19/008* (2013.01); *G10L 25/21* (2013.01)

(58) Field of Classification Search
CPC ..... G10L 19/008
USPC ..... 704/200, 500–504
See application file for complete search history.

(56) References Cited

U.S. PATENT DOCUMENTS 8,139,787 B2 * 3/2012 Haykin et al. ..... 381/94.1
8,638,951 B2 * 1/2014 Zurek et al. ..... 381/92

(Continued)

FOREIGN PATENT DOCUMENTS

JP 6-149292 5/1994
KR 1998-702591 7/1998

(Continued)

OTHER PUBLICATIONS

Hendrik Fuchs, "Improving Joint Stereo Audio Coding by Adaptive Inter-channel Prediction" 1993, Applications of Signal Processing to Audio and Acoustics, 1993. Final Program and Paper Summaries.

(Continued)

*Primary Examiner* — Douglas Godbold
(74) *Attorney, Agent, or Firm* — Harness, Dickey & Pierce, P.L.C.

(57) ABSTRACT

A speech signal transmission apparatus includes an extractor to extract speech signals from speech source signals collected by a plurality of microphones, a power calculator to calculate powers of speech signals of multiple channels and set any one of the speech signals of the multiple channels as a reference speech signal, a synchronization adjustor to adjust synchronization of the other speech signals based on the reference speech signal, a signal generator to generate extraction signals by offsetting the reference speech signal from the other synchronization-adjusted speech signals, an encryptor to compress and encrypt the reference speech signal and the extraction signals, and a transmitter to transmit the compressed and encrypted reference speech signal and extraction signals.

12 Claims, 6 Drawing Sheets

(56) References Cited

U.S. PATENT DOCUMENTS

| | | | | |
|---|---|---|---|---|
| 2005/0080616 | A1* | 4/2005 | Leung et al. | 704/200.1 |
| 2006/0015331 | A1* | 1/2006 | Hui et al. | 704/227 |
| 2008/0008323 | A1* | 1/2008 | Hilpert et al. | 381/1 |
| 2008/0130914 | A1* | 6/2008 | Cho | 381/94.1 |
| 2008/0310646 | A1* | 12/2008 | Amada | 381/73.1 |
| 2009/0055170 | A1* | 2/2009 | Nagahama | 704/226 |
| 2009/0076815 | A1* | 3/2009 | Ichikawa et al. | 704/233 |
| 2010/0014679 | A1* | 1/2010 | Kim et al. | 381/23 |
| 2010/0169102 | A1* | 7/2010 | Samsudin et al. | 704/500 |
| 2010/0198585 | A1* | 8/2010 | Mouhssine et al. | 704/200.1 |
| 2011/0313763 | A1* | 12/2011 | Amada | 704/233 |
| 2012/0045074 | A1* | 2/2012 | Li et al. | 381/94.1 |
| 2012/0130713 | A1* | 5/2012 | Shin et al. | 704/233 |
| 2012/0158404 | A1* | 6/2012 | Shin | 704/233 |
| 2012/0209603 | A1* | 8/2012 | Jing | 704/233 |
| 2012/0259628 | A1* | 10/2012 | Siotis | 704/233 |
| 2012/0284023 | A1* | 11/2012 | Vitte et al. | 704/233 |
| 2012/0316869 | A1* | 12/2012 | Xiang et al. | 704/226 |
| 2012/0330652 | A1* | 12/2012 | Turnbull et al. | 704/226 |
| 2013/0013303 | A1* | 1/2013 | Strommer et al. | 704/226 |
| 2013/0117014 | A1* | 5/2013 | Zhang et al. | 704/207 |

FOREIGN PATENT DOCUMENTS

| | | |
|---|---|---|
| KR | 10-0917845 | 9/2009 |
| WO | WO 96/27249 | 9/1996 |

OTHER PUBLICATIONS

Tilman Liebchen, "Lossless Audio Coding Using Adaptive Multichannel Prediction" Oct. 2002, Audio Engineering Society Convention Paper, pp. 1-7.

European Search Report issued Nov. 14, 2013 in corresponding European Application No. 12193761.9.

* cited by examiner

SPEECH SIGNAL TRANSMISSION AND RECEPTION APPARATUSES AND SPEECH SIGNAL TRANSMISSION AND RECEPTION METHODS

CROSS-REFERENCE TO RELATED APPLICATIONS

This application claims the benefit of Korean Patent Applications No. 2011-0124933 filed on Nov. 28, 2011 and No. 2012-0017252 filed on Feb. 21, 2012 in the Korean Intellectual Property Office, the disclosure of which is incorporated herein by reference.

BACKGROUND

1. Field

One or more embodiments relate to speech signal transmission and reception apparatuses and speech signal transmission and reception methods, which compress and then transmit speech signals and restore received speech signals.

2. Description of the Related Art

Generally, a speech signal transmission apparatus transmits speech signals by splitting them into several parameters indicating characteristics of a speech source and a resonance system, based on the idea that the speech signals are regarded as an output of the resonance system excited according to the speech source, and a speech signal reception apparatus synthesizes original speech signals according to the parameters.

The speech signal transmission and reception apparatuses include codecs which encode and decode speech signals in a frame unit. Among such codecs, for example, a G.729 codec receives a frame from a frame part and encodes and decodes the speech signals in units of 10 ms.

The frame part classifies samples which are successively transmitted at 8 KHz from the exterior into samples of 10 ms and provides 80 classified samples as one frame to the G.729 codec as an input signal.

The G.729 codec may be achieved using a Digital Signal Processor (DSP).

In this case, a memory of the DSP includes a code part which generates and stores executable code corresponding to the number of processed channels and a data part, a program use space, which stores global variables, channel buffer stacks, and the like.

In this codec, the number of achievable channels is determined according to the processing capabilities of the DSP. If the number of channels capable of being processed in the DSP increases, since execution codes corresponding to the number of channels should be generated, the necessary amount of the memory also increases.

Furthermore, when loss compression data is needed during compression of a multichannel speech signal or when lossless data is needed to maximize performance, the amount of signals of speech data to be transmitted increases in correspondence to the number of microphones.

Moreover, when speech signals are collected through multichannel microphones, synchronization of speech signals varies according to the location or characteristic of the microphones and powers between the speech signals become different. Accordingly, compression is not easy and compression efficiency is low.

SUMMARY

Therefore, it is an aspect of one or more embodiments to provide a speech signal transmission apparatus and a speech signal transmission method to adjust powers and synchronization of multichannel speech signals using the correlation between a plurality of microphones and then to encrypt and compress the speech signals for transmission.

It is another aspect of one or more embodiments to provide a speech signal reception apparatus and a speech signal reception method to restore received speech signals using power parameters and synchronization parameters.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one aspect of one or more embodiments, a speech signal transmission apparatus may include an extractor to extract speech signals from speech source signals collected by a plurality of microphones, a power calculator to calculate powers of speech signals of multiple channels and set any one of the speech signals of the multiple channels as a reference speech signal, a synchronization adjustor to adjust synchronization of the other speech signals based on the reference speech signal, a signal generator to generate extraction signals by offsetting the reference speech signal from the other synchronization-adjusted speech signals, an encryptor to compress and encrypt the reference speech signal and the extraction signals, and a transmitter to transmit the compressed and encrypted reference speech signal and extraction signals.

The power calculator may set a speech signal having the greatest power among the speech signals of the multiple channels to the reference speech signal.

The power calculator may calculate power parameters corresponding to the other speech signals based on ratios of powers of the other speech signals to a power of the reference speech signal.

The signal generator may generate offset signals corresponding to the other speech signals by applying the power parameters corresponding to the other speech signals to the reference speech signal and generate extraction signals by offsetting the offset signals from the other speech signals.

The signal generator may generate the extraction signals by subtracting a power of the reference voice signal from powers of the other speech signals.

The encryptor may encrypt information of a microphone by which the reference speech signal is collected, the extraction signals, information of the remaining microphones, power parameters, and synchronization parameters.

The synchronization adjustor may calculate synchronization parameters of the other speech signals based on distances between a microphone by which the reference speech signal is collected and microphones by which the other speech signals are collected and adjust synchronization of the other speech signals based on the calculated synchronization parameters.

The synchronization adjustor may adjust synchronization of the other speech signals using correlation between the plurality of microphones.

In accordance with another aspect of one or more embodiments, a speech signal reception apparatus may include a receiver to receive signals of multiple channels, a decoder to decode the received signals of the multiple channels into a reference speech signal and at least one extraction signal, a power restorer to restore a power of the at least one decoded extraction signal to obtain a speech signal, a synchronization restorer to restore synchronization of the at least one power-restored speech signal, a multiplexer to multiplex the reference speech signal and the at least one power-restored and synchronization-restored speech signal, and an output part to output the multiplexed speech signal.

The receiver may transmit the reference speech signal and at least one extraction signal from the received signals to the decoder and transmit information of the at least one extraction signal to the power restorer and the synchronization restorer.

The decoder may distinguish between the reference speech signal and the extraction signal by parsing headers of the received signals of the multiple channels.

The information of the at least one extraction signal may include information of a microphone by which the reference speech signal is collected, information of a microphone by which a speech signal to be decoded is collected, a power parameter, and a synchronization parameter.

The power restorer may restore a power of the extraction signal using the power parameter to generate a speech signal.

The synchronization restorer may restore synchronization of the power-restored speech signal using the synchronization parameter.

In accordance with another aspect of one or more embodiments, a speech signal transmission method may include collecting speech source signals by a plurality of microphones, extracting speech signals from the collected speech source signals, calculating powers of speech signals of multiple channels, setting any one of the speech signals of the multiple channels as a reference speech signal, adjusting synchronization of the other speech signals based on the reference speech signal, generating extraction signals by offsetting the reference speech signal from the other synchronization-adjusted speech signals, compressing and encrypting the reference speech signal and the extraction signals, and transmitting the compressed and encrypted reference speech signal and the compressed and encrypted extraction signals.

The setting of any one of the speech signals may include setting a speech signal having the greatest power among the speech signals of the multiple channels to the reference speech signal.

The generating of the extraction signals may include calculating power parameters corresponding to the other speech signals based on ratios of powers of the other speech signals to a power of the reference speech signal, generating offset signals corresponding to the other speech signals by applying power parameters corresponding to the other speech signals to the reference speech signal, and generating extraction signals by offsetting the offsetting signals from the other speech signals.

The compressing and encrypting of the reference speech signal and the extraction signals may include encrypting information of a microphone by which the reference speech signal is collected, the extraction signals, information of the remaining microphones, power parameters, and synchronization parameters.

The adjusting of synchronization of the other speech signals may include calculating synchronization parameters of the other speech signals based on distances between a microphone by which the reference speech signal is collected and microphones by which the other speech signals are collected, and adjusting synchronization of the other speech signals based on the calculated synchronization parameters.

In accordance with a further aspect of one or more embodiments, a speech signal reception method may include receiving signals of multiple channels, generating a reference speech signal, at least one extraction signal, and information of the at least one extraction signal by decoding the received signals of the multiple channels, and restoring a power of the at least one extraction signal and synchronization of the at least extraction signal based on the information of the at least one extraction signal.

The speech signal reception method may further include multiplexing the reference speech signal and the at least one power-restored and synchronization-restored speech signal, and generating the multiplexed speech signal.

The information of the at least one extraction signal may include information of a microphone by which the reference speech signal is collected, information of a microphone by which a speech signal to be decoded is collected, a power parameter, and a synchronization parameter.

The restoring of a power may include restoring a power of the extraction signal using the power parameter.

The restoring of synchronization may include restoring synchronization of the power-restored speech signal using the synchronization parameter.

The power parameter may be a ratio of a power of the at least one speech signal to a power of the reference speech signal.

BRIEF DESCRIPTION OF THE DRAWINGS

These and/or other aspects of the invention will become apparent and more readily appreciated from the following description of embodiments, taken in conjunction with the accompanying drawings of which.

DETAILED DESCRIPTION

Figure 1:
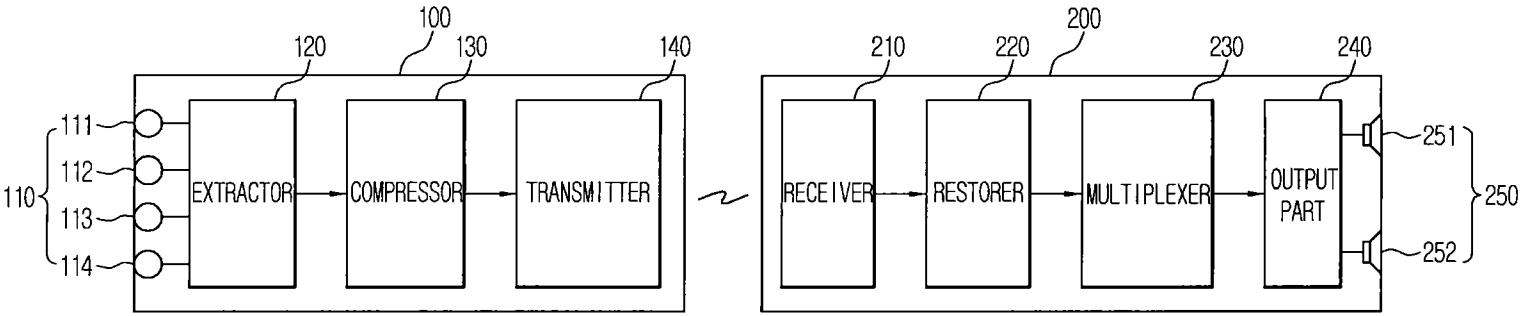
FIG. 1 is a diagram illustrating a configuration of a speech signal transmission apparatus and a speech signal reception apparatus according to an one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
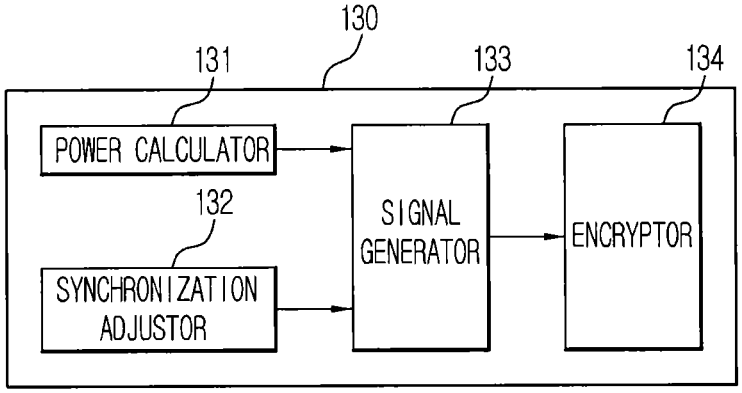
FIG. 2 is a diagram illustrating a detailed configuration of a speech signal transmission apparatus according to one or more embodiments.
Figure 3:
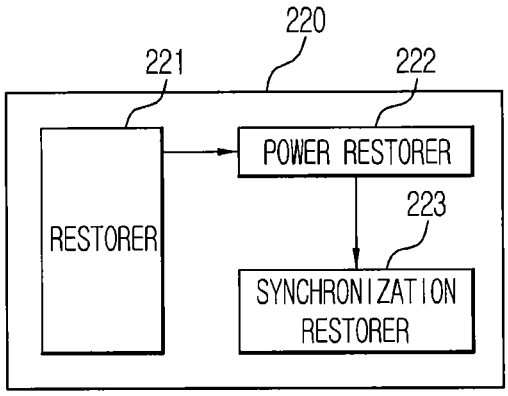
FIG. 3 is a diagram illustrating a detailed configuration of a speech signal reception apparatus according to one or more embodiments.

FIG. 1 is a diagram illustrating a configuration of a speech signal transmission apparatus and a speech signal reception apparatus according to one or more embodiments. FIG. 2 is a diagram illustrating a detailed configuration of a speech signal transmission apparatus according to one or more embodiments. FIG. 3 is a diagram illustrating a detailed configuration of a speech signal reception apparatus according to one or more embodiments.

A speech signal transmission apparatus 100 and a speech signal reception apparatus 200 may be located within different terminals and transmit and receive speech signals to monitor and recognize voice through a network within different terminals.

For example, a robot (terminal) having multichannel microphones may receive speech signals and transmit the speech signals to a remote base station and a remote client so as to process the multichannel speech signals.

In this case, the speech signal transmission apparatus 100 may compress and then transmit the speech signals for smooth transmission and reception of the speech signals, and the speech signal reception apparatus 200 may receive the compressed speech signals and restore the compressed speech signals.

Namely, the speech signal transmission apparatus 100 may collect speech sources, extract speech signals from the collected speech sources, may compress compress and encrypt the extracted speech signals, and may transmit the compressed and encrypted speech signals to the speech signal reception apparatus 200.

Upon receiving the compressed and encrypted speech signals, the speech signal reception apparatus 200 may decode and restore the received speech signals and may output the decoded and restored speech signals.

As illustrated in FIG. 1, the speech signal transmission apparatus 100 may include, for example, a collector 110, an extractor 120, a compressor 130, and a transmitter 140.

The collector 110 may include a plurality of microphones 111 to 114 installed at regular intervals. The plurality of microphones 111 to 114 may refer to devices which receive sound waves or ultrasonic waves and generate electric signals according to vibration of the sound waves or ultrasonic waves, wherein the electric signals may correspond to speech source signals.

Regular intervals between the plurality of microphones may be previously stored. It may be possible to previously store information about locations between the plurality of microphones.

The plurality of microphones 111 to 114 may collect ambient speech sources and may transmit signals of the collected speech sources to the extractor 120.

The extractor 120 may extract speech signals from the multichannel speech source signals transmitted through the plurality of microphones 111 to 114.

The compressor 130 may set a speech signal of any one channel among speech signals of multiple channels as a reference speech signal, may reduce the capacity of the other speech signals based on the correlation between the reference speech signal and the other speech signals, and may encrypt and compress the reference speech signal and the other capacity-reduced speech signals.

The transmitter 140 may transmit the compressed and encrypted reference speech signal and the other compressed and encrypted speech signals to the speech signal reception apparatus 200.

The compressor 130 is described in more detail with reference to FIG. 2.

The compressor 130 may include, for example, a power calculator 131, a synchronization adjustor 132, a signal generator 133, and an encryptor 134.

The power calculator 131 may calculate powers of the speech signals of multiple channels, set a speech signal of any one channel among the speech signals of the multiple channels as a reference speech signal, and calculate power parameters based on ratios of the powers of the other speech signals to the power of the reference speech signal.

The reference speech signal may indicate a speech signal having the greatest power among the speech signals of the multiple channels.

For example, if there are, for example, a first speech signal collected by a first microphone, a second speech signal collected by a second microphone, a third speech signal collected by a third microphone, and a fourth speech signal collected by a fourth microphone, then the powers of the first, second, third, and fourth speech signals may be calculated and the speech signal having the greatest power may be set to the reference speech signal.

The reference speech signal may be set such that a reference microphone is previously determined and a speech signal collected by the reference microphone is set to the reference speech signal. It may also be possible to set a speech signal having the least power to the reference speech signal.

The power of the speech signal may be calculated using a mean square power.

Assuming that the first speech signal is the reference speech signal, then a first power parameter for the first speech signal may be 1, a second power parameter for the second speech signal may be a ratio of the power of the second speech signal to the power of the reference speech signal, a third power parameter for the third speech signal may be a ratio of the power of the third speech signal to the power of the reference speech signal, and a fourth power parameter for the fourth speech signal may be a ratio of the power of the fourth speech signal to the power of the reference speech signal.

The power calculator 131 may provide the speech signals of the microphones, the reference speech signal, and the power parameters of the other speech signals.

The synchronization adjustor 132 may adjust the synchronization of the other speech signals based on the reference speech signal.

The synchronization adjustor 132 may adjust the synchronization using the correlation between the speech signals.

A minimum difference value may be calculated using the difference between the speech signals, and a synchronization parameter may be calculated using the minimum difference value. It may also be possible to calculate the synchronization parameter based on the distance between the microphones.

The synchronization adjustor 132 may generate a synchronization table based on a microphone by which the reference speech signal may be collected and may adjust the synchronization of the other speech signal based on the synchronization table.

The signal generator 133 may generate offset signals by applying the power parameters to the reference speech signal. In other words, the offset signals may be obtained by changing the reference speech signal by use of the power parameters corresponding to the other speech signals.

For example, when it is desired to offset the reference speech signal from the second speech signal, if the power of the reference speech signal may be different from the power of the second speech signal, the power of the reference speech signal may be adjusted using the second power parameter so that the power of the reference speech signal may correspond to the power of the second speech signal. Next, an offset signal in which the power of the reference speech signal may be adjusted may be subtracted from the second speech signal to obtain an extraction signal.

Namely, the signal generator 133 may generate new signals by subtracting the offset signals from the other speech signals. The new signals may be extraction signals obtained after the offset signals are subtracted from the other speech signals.

The encryptor 134 may compress and encrypt the reference speech signal and the extraction signals with respect to respective channels.

In this case, an extraction signal of each channel and information of the extraction signal may be transmitted. The information may include information of a reference microphone by which the reference speech signal is collected, information of a microphone by which a speech signal to be encrypted is collected, a power parameter, a synchronization parameter, etc. The respective information may be transmitted as one packet.

As illustrated in FIG. 1, the speech signal reception apparatus 200 may include, for example, a receiver 210, a restorer 220, a multiplexer 230, an output part 240, and a speaker part 250 consisting of a plurality of speakers 251 and 252.

The receiver 210 may receive the reference speech signal of the multiple channels, at least one extraction signal, and information of the extraction signal, which may be transmitted from the speech signal transmission apparatus 100. The receiver 210 may transmit the received reference speech signal and the at least one extraction signal to a decoder 221 of the restorer 220 and may transmit the received information of the extraction signal to a power restorer 222 and a synchronization restorer 223 of the restorer 220.

The restorer 220 may decompress the compressed reference speech signal of the multiple channels and the at least one compressed extraction signal and restore the power and synchronization of the at least one decompressed extraction signal, thereby possibly generating at least one speech signal.

The multiplexer 230 may simultaneously transmit the speech signals of multiple channels through one channel. Namely, the multiplexer 230 may multiplex the reference speech signal and at least one speech signal.

The output part 240 may output the multiplexed speech signals.

The output part 240 may convert a digital speech signal into an analog speech signal and may amplify the converted analog speech signal.

The speakers 251 and 252 are devices which convert electrical signals into vibration of a diaphragm to radiate sound waves by generating condensation and refraction waves in the air. Here, the electric signals may indicate the restored speech signals.

The restorer 220 is described in more detail with reference to FIG. 3.

The restorer 220 may include, for example, the decoder 221, the power restorer 222, and the synchronization restorer 223.

The decoder 221 may decompress the reference speech signals of the multiple channels and the at least one extraction signal, which may be transmitted from the receiver 210.

The power restorer 222 may restore the power of the at least one extraction signal to possibly obtain a speech signal using the power parameter among the information of the extraction signal received from the receiver 210.

In this case, the power restorer 222 may generate an additional signal by applying the power parameter to the reference speech signal and may add the additional signal to the at least one speech signal, thereby possibly restoring the speech signal.

The synchronization restorer 223 may restore the synchronization of the at least one speech signal using the synchronization parameter among the information of the extraction signal received from the receiver 210.

In this case, the at least one speech signal may be shifted by an initially shifted synchronization parameter.

Figure 4:
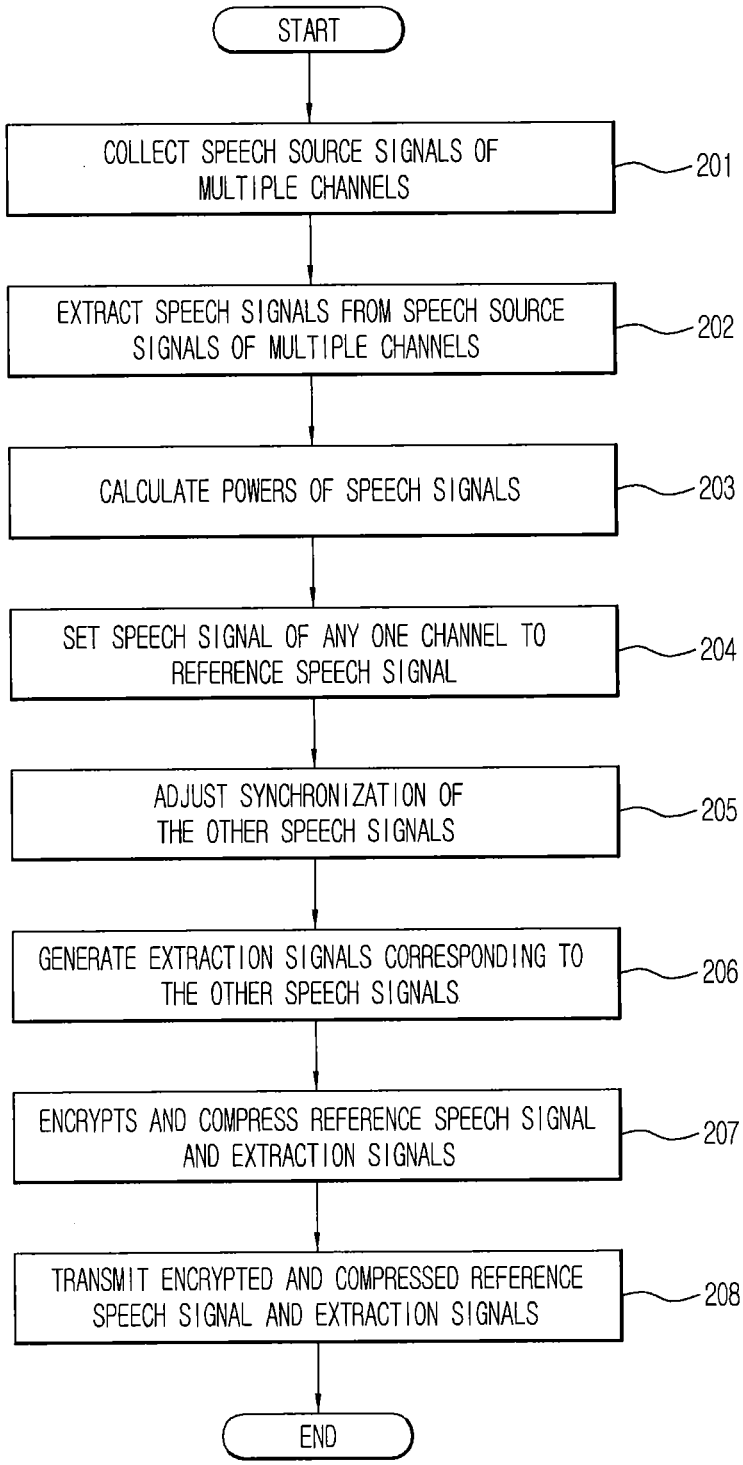
FIG. 4 is a flowchart of a speech signal transmission method according to one or more embodiments.

FIG. 4 is a flowchart of a speech signal transmission method according to one or more embodiments. The speech signal transmission method is described with reference to FIGS. 5A to 5E.

First, the speech signal transmission apparatus may collect ambient speech source signals through the plurality of microphones 111 to 114 installed at regular intervals (step 201).

The speech signal transmission apparatus may extract speech signals from speech source signals of multiple channels (step 202) and may calculate the powers of the speech signals of the multiple channels (step 203). The speech signal transmission apparatus may set a speech signal of any one channel among the speech signals of the multiple channels as a reference speech signal (step 204).

The speech signal transmission apparatus may calculate power parameters based on ratios of the powers of the other speech signals to the power of the reference speech signal.

For example, if a power parameter of the reference speech signal is p1, then power parameters p2, p3, and p4 of second, third, and fourth speech signals may be as follows:

$p2$=power of second speech signal/power of reference speech signal, $p3$=power of third speech signal/power of reference speech signal, and $p4$=power of fourth speech signal/power of reference speech signal where the power of each speech signal may be calculated using a mean square power and may be expressed as an integer.

Next, the speech signal transmission apparatus may adjust synchronization using the correlation between the speech signals. In this case, the speech signal transmission apparatus may adjust the synchronization of the other speech signals based on the reference speech signal (step 205).

Here, synchronization may be to adjust a delay time according to the distance between the microphones.

Synchronization parameters of the speech signals may be calculated using the minimum difference value or correlation between the microphones.

In this case, among speech signals that may be adjusted by the synchronization parameters, the first speech signal which may be eliminated through synchronization adjustment may be connected to the last signal.

When a measurement value is actually obtained, synchronization of a signal at the front of a linear microphone may typically be 0 and synchronization at the side of a microphone or in a circular microphone may have a lower parameter than synchronization of the microphone of the front although there may be variation according to resolution.

When the number of microphones is 4, if a first speech signal is a reference speech signal, synchronization-adjusted signals of the other speech signals may be as follows:

second synchronization-adjusted speech signal=second speech signal+$s2$(cyclic)

third synchronization-adjusted speech signal=third speech signal+$s3$(cyclic)

fourth synchronization-adjusted speech signal=fourth speech signal+$s4$(cyclic)

where s2, s3, and s4 are synchronization parameters that may be adjusted based on the first speech signal.

Next, the speech signal transmission apparatus may generate offset signals by applying power parameters to the reference speech signal. Namely, the offset signals may be obtained by converting the reference speech signal based on the power parameters corresponding to the other speech signals.

The speech signal transmission apparatus may generate new extraction signals by subtracting the offset signals from the other speech signals (step 206). The new extraction signals may be signals extracted after the offset signals are subtracted from the other speech signals.

For example, when the number of microphones is 4, if a first speech signal is a reference speech signal, a process of generating extraction signals corresponding to the other speech signals may be as follows:

second extraction signal=second synchronization-adjusted speech signal−(second power parameter*reference speech signal)

third extraction signal=third synchronization-adjusted speech signal−(third power parameter*reference speech signal)

fourth extraction signal=fourth synchronization-adjusted speech signal−(fourth power parameter*reference speech signal)

Next, the speech signal transmission apparatus may encrypt and compress the reference speech signal and the extraction signals for respective channels (step 207).

In this case, the reference speech signal, each extraction signal, and information of the extraction signal may be encrypted and compressed all together.

The information of the extraction signal may include a microphone number of a microphone by which a speech signal to be encrypted may be collected, a microphone number of a microphone by which reference voice data may be collected, a power parameter, and a synchronization parameter, and all of them may be transmitted as one packet.

Moreover, the reference speech signal, the microphone number, the power parameter, and the synchronization parameter may all be transmitted.

The speech signal transmission apparatus may transmit the encrypted and compressed reference speech signal and extraction signals to the speech signal reception apparatus 200 (step 208).

A process of generating the extraction signals is described in more detail with reference to FIGS. 5A to 5E.

A first speech signal may be collected through a microphone of a first channel CH1 and a second speech signal may be collected through a microphone of a second channel CH2.

Figure 5:
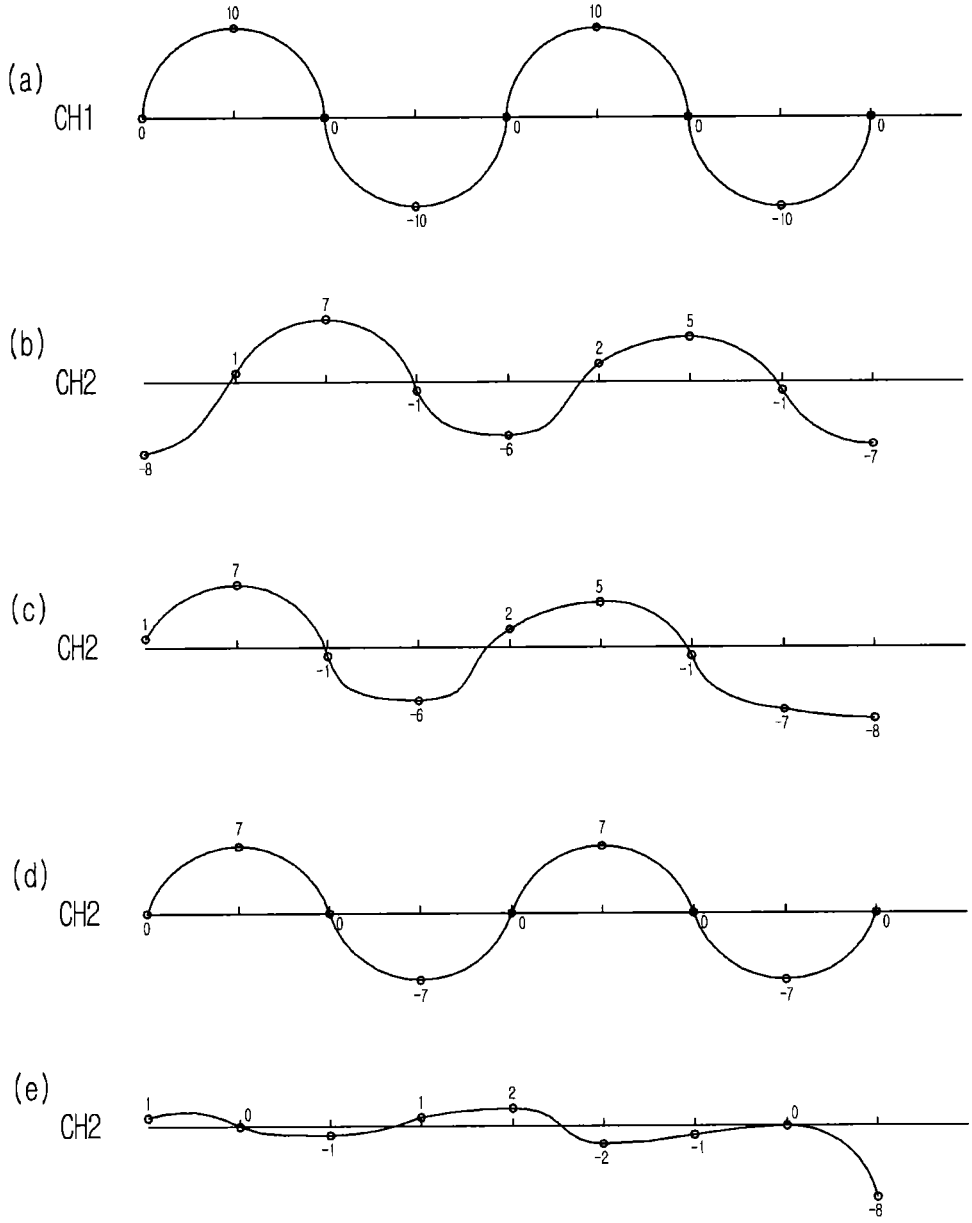
FIG. 5 parts (a)-(e) are diagrams illustrating examples of generating an extraction signal before transmitting a speech signal according to one or more embodiments.

The first speech signal collected through the microphone of the first channel CH1 may be as shown in FIG. 5A and the second speech signal collected through the microphone of the second channel CH2 may be as shown in FIG. 5B.

Next, the power of the first speech signal and the power of the second speech signal may be calculated. The power of each speech signal may be calculated using mean square power and may be expressed as an integer.

In this case, the power of the first speech signal may be as follows, for example:

$$\sqrt{\frac{0^2+10^2+0^2+(-10)^2+0^2+10^2+0^2+(-10)^2+0^2}{9}}=7$$

The power of the second speech signal may be as follows, for example:

$$\sqrt{\frac{(-8)^2+(1)^2+(7)^2+(-1)^2+(-6)^2+(2)^2+5^2+(-1)^2+(-7)^2}{9}}=5$$

The power of the first speech signal may be 7, for example, and the power of the second speech signal may be 5, for example. Namely, since the power of the second speech signal is less than the power of the first speech signal in this example, the first speech signal may be set to the reference speech signal and the second speech signal collected through the microphone of the second channel CH2 may be converted into the extraction signal.

As illustrated in FIG. 5C, the synchronization of the second speech signal may be adjusted based on the reference speech signal. In more detail, the second speech signal may be shifted to the left by a ¼ cycle so that the waveform of the reference speech signal may correspond to the waveform of the second speech signal.

Next, the power parameter may be calculated. The power parameter is a ratio of the power of the second speech signal to the power of the reference speech signal, that is, in this example, 5/7.

Thereafter, an offset signal is generated by applying, in this example, 5/7 to the reference speech signal which may be the first speech signal of the first channel (CH1) shown in FIG. 5A. Here, the offset signal may be expressed as an integer.

The offset signal may have values of 0, 7, 0 −7, 0, 7, 0, −7, and 0 as in this example shown in FIG. 5D.

If the powers of the reference speech signal and the second speech signal differ, each value of the reference speech signal may be adjusted by applying the power parameter to the reference speech signal so that the power of the reference speech signal corresponds to the power of the second speech signal. In this case, the reference speech signal, each value of which may be adjusted by the power parameter, may become the offset signal.

As illustrated in FIG. 5E, an extraction signal may be generated by subtracting the offset signal from the second synchronization-adjusted speech signal.

In this example, the extraction signal may have values of 1(=1−0), 0(=7−7), −1(=−1−0), 1(=−6−(−7)), 2(=2−0), −2(=5−7), 1(=−1−0), 0(=−7−(−7)), and −8(=−8−0).

Figure 6:
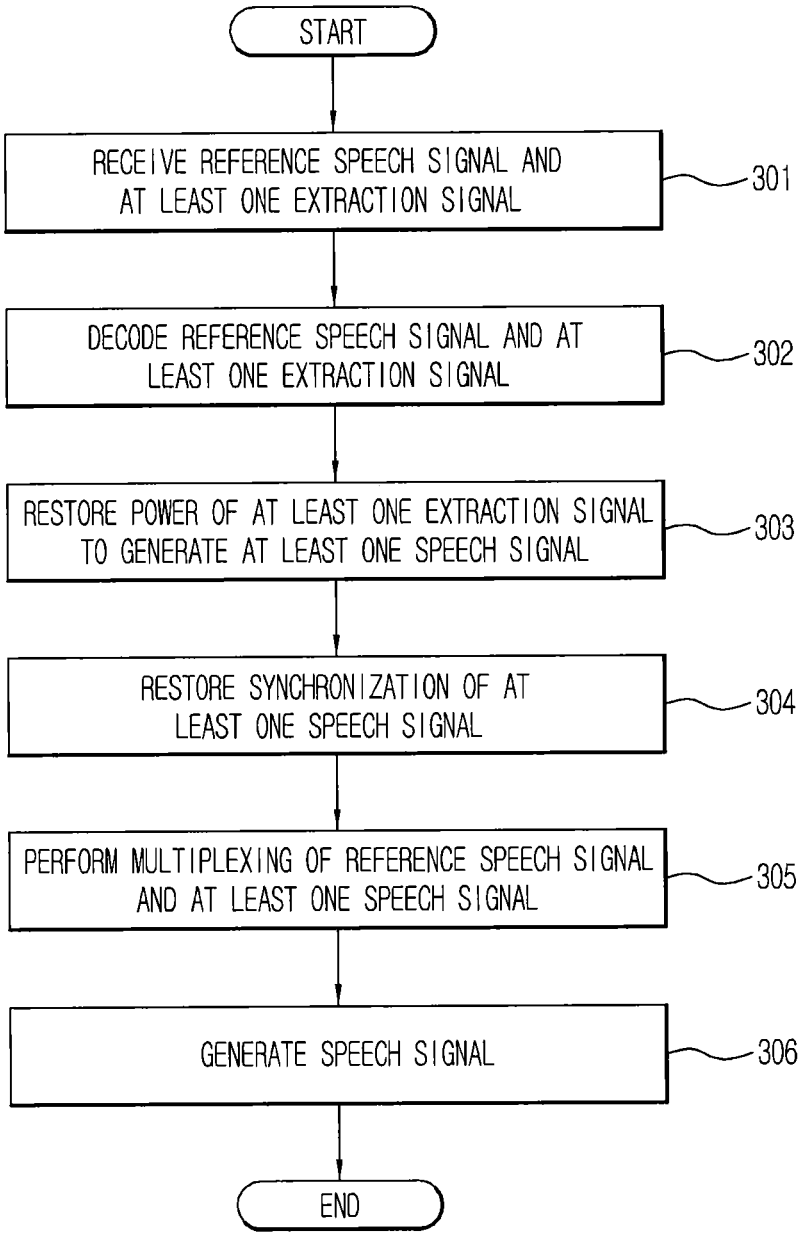
FIG. 6 is a flowchart of a speech signal reception method according to one or more embodiments.

FIG. 6 is a flowchart of a speech signal reception method according to one or more embodiments. The speech signal reception method is described with reference to FIGS. 7A to 7C.

The speech signal reception apparatus may receive, for example, the reference speech signal of the multiple channels, the at least one extraction signal, and the information of the extraction signal from the speech signal transmission apparatus 100 (step 301). The speech signal reception apparatus may decompress the reference speech signal and the at least one extraction signal and may decode the decompressed reference speech signal and at least one extraction signal (step 302).

In this case, the reference speech signal of the multiple channels and the at least one extraction signal, and the information of the extraction signal may be generated.

The speech signal reception apparatus may parse a header of the received signal to possibly distinguish between the reference speech signal and the extraction signal. The decompressed reference speech signal may be transmitted to the multiplexer.

The speech signal reception apparatus may restore the power of the at least one extraction signal using a power parameter among information of the extraction signal to possibly generate at least one speech signal (step 303). The speech signal reception apparatus may restore the synchronization of the at least one power-restored speech signal using a synchronization parameter among the information of the extraction signal so that an initial speech signal may possibly be restored (step 304).

In this case, the at least one speech signal may be shifted by an initially shifted synchronization parameter from the speech signal transmission apparatus 100.

For example, when speech sources are collected through four microphones, if a first speech signal is a reference speech signal, power restoration signals and synchronization restoration signals of the extraction signals corresponding to second, third, and fourth speech signals may be as follows:

second power restoration signal=second extraction signal+second power parameter*reference microphone signal third power restoration signal=third extraction signal+third power parameter*reference microphone signal fourth power restoration signal=fourth extraction signal+fourth power parameter*reference microphone signal second synchronization restoration signal=second power restoration signal−*s*2(cyclic)

third synchronization restoration signal=third power restoration signal−*s*3(cyclic)

fourth synchronization restoration signal=fourth power restoration signal−*s*4(cyclic)

Here, s2, s3, and s4 may denote synchronization parameters that may be adjusted based on the first speech signal which may be the reference speech signal.

The speech signal reception apparatus may perform multiplexing of the reference speech signal of the multiple channels and at least one speech signal (step 305) and may generate the multiplexed speech signal through at least one speaker (step 306).

A process of restoring at least one extraction signal is described in detail with reference to FIGS. 7A to 7C.

Figure 7:
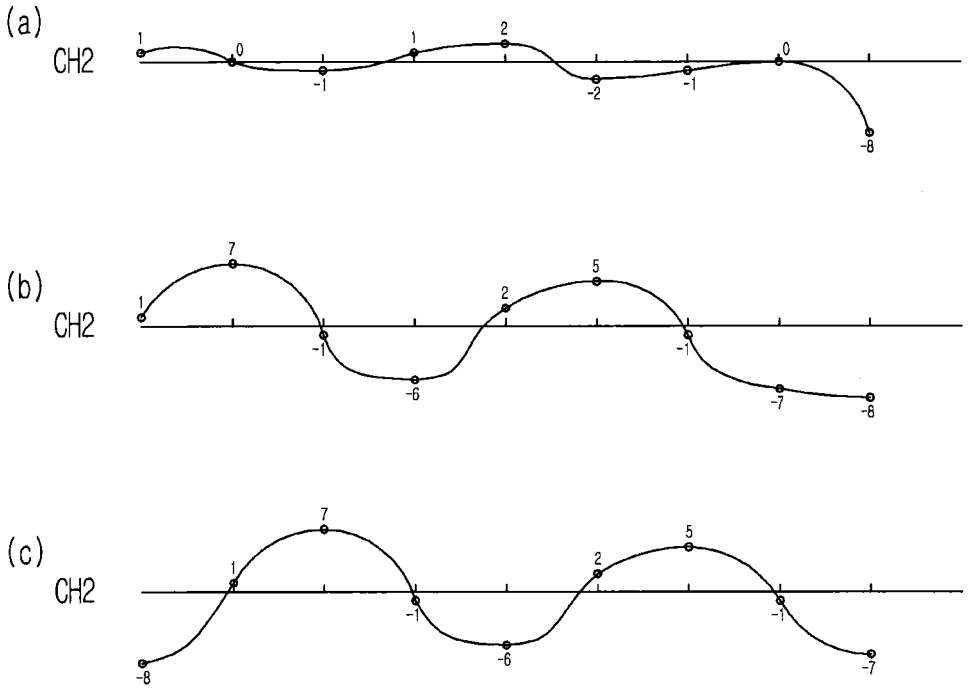
FIG. 7 parts (a)-(c) are diagrams illustrating examples of restoring a speech signal after receiving the speech signal according to one or more embodiments.

As illustrated in FIG. 7A, if an extraction signal is received, an additional signal may be generated by applying a power parameter among information of the extraction signal to a reference speech signal as illustrated in FIG. 7B and the generated additional signal may be added to the extraction signal.

As illustrated in FIG. 7C, synchronization may be restored by shifting the speech signal using the synchronization parameter.

As is apparent from the above description, because the capacity of the remaining speech signals may be reduced based on the reference speech signal before the speech signals of multiple channels are compressed, compression efficiency may be raised, time may be reduced, and it is easy to restore the speech signals.

Furthermore, compression efficiency of 1% to 3% may be obtained based on lossless compression.

In one or more embodiments, any apparatus, system, element, or interpretable unit descriptions herein include one or more hardware devices or hardware processing elements. For example, in one or more embodiments, any described apparatus, system, element, retriever, pre or post-processing elements, tracker, detector, encoder, decoder, etc., may further include one or more memories and/or processing elements, and any hardware input/output transmission devices, or represent operating portions/aspects of one or more respective processing elements or devices. Further, the term apparatus should be considered synonymous with elements of a physical system, not limited to a single device or enclosure or all described elements embodied in single respective enclosures in all embodiments, but rather, depending on embodiment, is open to being embodied together or separately in differing enclosures and/or locations through differing hardware elements.

In addition to the above described embodiments, embodiments can also be implemented through computer readable code/instructions in/on a non-transitory medium, e.g., a computer readable medium, to control at least one processing device, such as a processor or computer, to implement any above described embodiment. The medium can correspond to any defined, measurable, and tangible structure permitting the storing and/or transmission of the computer readable code.

The media may also include, e.g., in combination with the computer readable code, data files, data structures, and the like. One or more embodiments of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Computer readable code may include both machine code, such as produced by a compiler, and files containing higher level code that may be executed by the computer using an interpreter, for example. The media may also be any defined, measurable, and tangible distributed network, so that the computer readable code is stored and executed in a distributed fashion. Still further, as only an example, the processing element could include a processor or a computer processor, and processing elements may be distributed and/or included in a single device.

The computer-readable media may also be embodied in at least one application specific integrated circuit (ASIC) or Field Programmable Gate Array (FPGA), as only examples, which execute (e.g., processes like a processor) program instructions.

While aspects of the present invention has been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A speech signal transmission apparatus comprising:

an extractor to extract a plurality of speech signals from a plurality of speech source signals collected by a plurality of microphones;

a power calculator to calculate a plurality of powers of the plurality of speech signals and set any one speech signal among the plurality of speech signals of the multiple channels as a reference speech signal;

a synchronization adjustor to calculate a plurality of synchronization parameters of the speech signals among the plurality of speech signals excluding the reference speech signal and to adjust synchronization of the speech signals among the plurality of speech signals excluding the reference speech signal based on the reference speech signal;

a signal generator to generate a plurality of extraction signals by offsetting the reference speech signal from each synchronization-adjusted speech signal;

an encryptor to compress and encrypt the reference speech signal and the plurality of extraction signals; and a transmitter to transmit the compressed and encrypted reference speech signal and the compressed and encrypted plurality of extraction signals, wherein the power calculator calculates power parameters corresponding to each speech signal among the plurality of speech signals excluding the reference speech signal based on a ratio of a power of each speech signal to a power of the reference speech signal, and wherein the signal generator operates offset signals corresponding to each speech signal among the plurality of speech signals excluding the reference speech signal by applying each power parameter corresponding to each speech signal to the reference speech signal and generates extraction signals by subtracting each offset signal from each speech signal.

2. The speech signal transmission apparatus according to claim 1, wherein the power calculator sets a speech signal having the greatest power among the plurality of speech signals of the multiple channels as the reference speech signal.

3. The speech signal transmission apparatus according to claim 1, wherein the signal generator generates the plurality of extraction signals by subtracting a power of the reference voice signal from a power of each speech signal among the plurality of speech signals excluding the reference speech signal.

4. The speech signal transmission apparatus according to claim 1, wherein the encryptor encrypts information of a microphone among the plurality of microphones by which the reference speech signal is collected, the plurality of extraction signals, information of the microphones among the plurality of microphones excluding the microphone among the plurality of microphones by which the reference speech signal is collected, the plurality of powers, and the plurality of synchronization parameters.

5. The speech signal transmission apparatus according to claim 1, wherein the synchronization adjustor calculates the plurality of synchronization parameters based on distances between a microphone by which the reference speech signal is collected and the plurality of microphones excluding the microphone by which the reference speech signal is collected and adjusts synchronization of each speech signal among the plurality of speech signals excluding the reference speech signal based on the plurality of synchronization parameters.

6. The speech signal transmission apparatus according to claim 1, wherein the synchronization adjustor adjusts synchronization of the speech signals among the plurality of speech signals excluding the reference speech signal using correlation between the plurality of microphones.

7. A speech signal transmission method comprising:

collecting a plurality of speech source signals by a plurality of microphones;

extracting a plurality of speech signals from the collected plurality of speech source signals;

calculating powers of the plurality of speech signals;

setting any one of the plurality of speech signals as a reference speech signal;

adjusting synchronization of the speech signals among the plurality of speech signals excluding the reference speech signal based on the reference speech signal;

generating a plurality of extraction signals by offsetting the reference speech signal from the synchronization-adjusted speech signals;

compressing and encrypting the reference speech signal and the plurality of extraction signals; and transmitting the compressed and encrypted reference speech signal and the compressed and encrypted plurality of extraction signals, wherein the generating the plurality of extraction signals includes calculating a plurality of power parameters corresponding to the speech signals among the plurality of speech signals excluding the reference speech signal based on ratios of powers of the speech signals to a power of the reference speech signal, generating a plurality of offset signals corresponding to the speech signals by applying the plurality of power parameters to the reference speech signal, and generating a plurality of extraction signals by subtracting each offset signal from each speech signal.

8. The speech signal transmission method according to claim 7, wherein the setting of any one of the speech signals comprises setting a speech signal among the plurality of speech signals having the greatest power as the reference speech signal.

9. The speech signal transmission method according to claim 7, wherein the compressing and encrypting of the reference speech signal and the extraction signals comprises encrypting information of a microphone among the plurality of microphones by which the reference speech signal is collected, the plurality of extraction signals, information of the microphones among the plurality of microphones excluding the microphone among the plurality of microphones by which the reference speech signal is collected, the plurality of powers, and the plurality of synchronization parameters.

10. The speech signal transmission method according to claim 7, wherein the adjusting synchronization of the speech signals comprises:

calculating a plurality of synchronization parameters based on distances between a microphone by which the reference speech signal is collected and the plurality of microphones excluding the microphone by which the reference signal is collected; and adjusting synchronization of each speech signal among the plurality of speech signals excluding the reference speech signal based on the plurality of synchronization parameters.

11. A speech signal transmission method comprising:

setting a reference speech signal as any one speech signal among a plurality of speech signals;

adjusting synchronization of the speech signals among the plurality of speech signals excluding the reference speech signal based on the reference speech signal;

generating a plurality of extraction signals by offsetting the reference speech signal from the synchronization-adjusted speech signals;

transmitting the reference speech signal and the plurality of extraction signals, wherein the generating the plurality of extraction signals includes calculating a plurality of power parameters corresponding to the speech signals among the plurality of speech signals excluding the reference speech signal based on ratios of powers of the speech signals to a power of the reference speech signal, generating a plurality of offset signals corresponding to the speech signals by applying the plurality of power parameters to the reference speech signal, and generating a plurality of extraction signals by subtracting each offset signal from each speech signal.

12. The speech signal transmission method according to claim 11 further comprising:

calculating powers of the plurality of speech signals, wherein the setting the reference speech signal comprises setting a speech signal having the greatest power among the plurality of speech signals as the reference speech signal.

* * * * *